US006565090B2

(12) United States Patent
Aldridge

(10) Patent No.: US 6,565,090 B2
(45) Date of Patent: May 20, 2003

(54) BOARD GAME SIMULATING WAYS TO PREVENT GLOBAL DISASTERS FROM OCCURRING

(76) Inventor: Rychlund Tasman Aldridge, La Petite Fosse Haut du Marais, St Ouen JE3 2GN Jersey (GB)

( * ) Notice: Subject to any disclaimer, the term of this patent is extended or adjusted under 35 U.S.C. 154(b) by 0 days.

(21) Appl. No.: 10/001,799

(22) Filed: Dec. 5, 2001

(65) Prior Publication Data

US 2002/0121740 A1 Sep. 5, 2002

Related U.S. Application Data

(60) Provisional application No. 60/251,009, filed on Dec. 5, 2000.

(51) Int. Cl.[7] ..... A63F 3/00

(52) U.S. Cl. ..... 273/254; 273/251; 273/252; 273/262

(58) Field of Search ..... 273/251, 252, 273/254, 236, 255, 248, 262

(56) References Cited

U.S. PATENT DOCUMENTS 5,088,739 A * 2/1992 Mitchell ..... 273/142 J
5,797,601 A * 8/1998 Ritchie ..... 273/431
6,402,143 B1 * 6/2002 Brindley ..... 273/143 A

* cited by examiner

*Primary Examiner*—Benjamin H. Layno
*Assistant Examiner*—Vishu K. Mendiratta
(74) *Attorney, Agent, or Firm*—Young & Thompson

(57) ABSTRACT

A game and a method of playing a game provide for a way to establish one among a plurality of disasters to be prevented by players as well as a variety of ways to prevent the predetermined disaster from occurring. In one embodiment, the disaster is represented by disaster cards and players move tokens around a game board from one airport to another collecting other types of cards in an attempt to be the first to prevent the predetermined disaster from occurring. There may also be provided a mechanism to enforce a time limit within which the disaster must be prevented for there to be a winner.

13 Claims, 5 Drawing Sheets

BOARD GAME SIMULATING WAYS TO PREVENT GLOBAL DISASTERS FROM OCCURRING

This application claims benefit of U.S. provisional application No. 60/251,009, filed Dec. 5, 2000.

BACKGROUND OF THE INVENTION

THIS INVENTION relates to a game and game apparatus. It related in particular to a board game and apparatus therefor.

SUMMARY OF THE INVENTION

According to a first aspect of the invention there is provided a game which includes means for establishing the nature of at least one pre-defined disaster to be prevented by players of the game; and means obtainable by or accessible to said players, for preventing said disaster from occurring.

The disaster may be a disaster capable of threatening life on a selected planted, e.g. the Earth. Typically, the disaster is a disaster capable of threatening human civilisation as it is presently known on Earth. The disaster may be real or imagined. For example, the disaster may be selected from the group consisting of nuclear war, asteroid collision, volcano eruption, global warming, and alien invasion.

The means for preventing the disaster from occurring may include tokens, e.g. collectable cards, each card presenting at least one solution to said disaster. The number of solutions required to overcome the disaster may be determined in advance by a set of rules provided by the game, and may be determined with reference to the number of players of the game.

Preferably, although not necessarily, the game includes means for establishing a limited time within which players must prevent said disaster, before the disaster occurs. For example, the game may include a time-line or grid that is traversed by a counter in accordance with the outcome of consecutive throws of a dice, such that over the course of time the counter will reach the end of the time-line or grid to signify occurrence of the disaster. This feature of the game requires a player not only to play against other players but also against time.

Preferably, although not necessarily, the game is a board game and includes a playing board. The playing board may bear a schematic representation of a map of a planet, for example, the Earth. Preferably still, each continent of the map may be differently coloured. The board may bear representations of flight paths and airports, the flight paths being traversable by players' playing pieces or counters during play of the game thereby to reach the airports.

Thus, the board game may further include playing pieces or counters. In a preferred embodiment of the invention, each playing piece is differently coloured and the colour of each player's playing piece corresponds with the colour of a particular continent represented on the playing board.

The game may include means (e.g. cards) permitting players to obstruct the play of other players of the game; for example, it may include cards which empower a player to send opponents to other areas of the playing board (e.g. to the airports of different continents). It may further include means to permit players to take cards from opponents.

In a second aspect of the invention there is provided game apparatus for playing the game described above. The apparatus may include a playing board as described above. The apparatus may further include playing pieces as described above, disaster cards for presenting various disasters to be pre-defined and prevented during play of the game, solution cards for presenting solutions for preventing said disaster, problem cards for introducing problems encountered by players during play, destination cards for designating destinations for players to reach during play, landing cards required for landing at a particular destination airport during play, dice, and the like. Each solution card may present solutions for a limited number of the disasters only (e.g. for four out of five disasters) so that not every solution card will be effective as a solution to the prevailing impending disaster.

The game apparatus may include playing pieces or counters (referred to as "aircraft" herein), each of which comprises a base and a body portion shaped to resemble an aircraft. The apparatus may further include a playing piece or counter (referred to as a "disaster piece" herein) that comprises a base and a body portion shaped to resemble a question mark. The game apparatus may also include a customised dice bearing the following on its six faces: −1, +2, a green spot (two sides), a black spot, and an asterisk.

The invention will now be described by way of example with reference to the accompanying diagrammatic drawings, in which like reference numerals identify correspondingly throughout. The following specific description is of an embodiment of the invention which is in the form of a board game. However, it is to be understood that the game may similarly be presented in the form of a computer game, a game for a games console, or the like.

BRIEF DESCRIPTION OF THE DRAWINGS

In the drawings:

FIG. 8 shows the back of a landing card, while

FIG. 12 shows the back of a problem card, while

Figure 1:
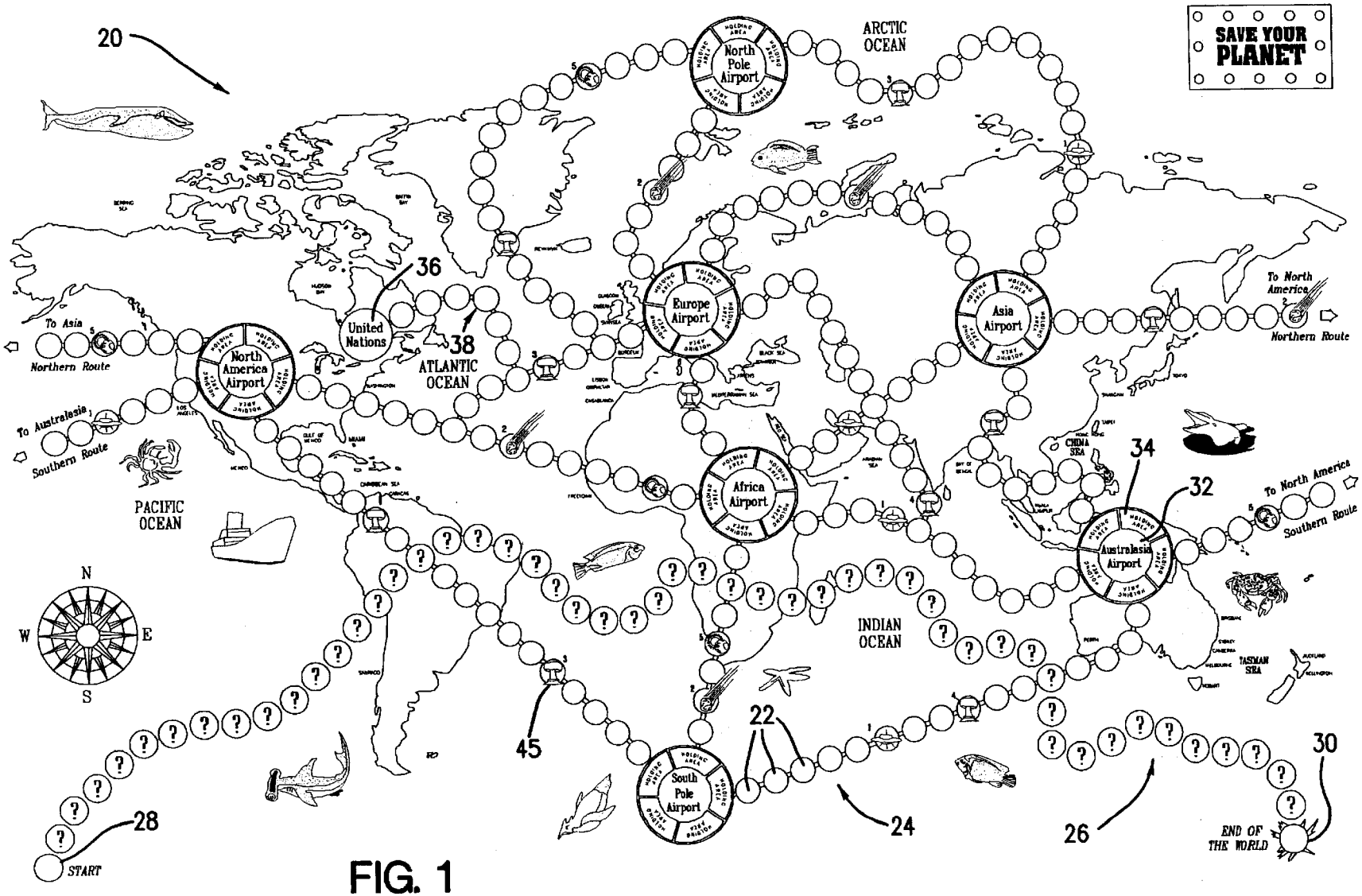
FIG. 1 shows, schematically, a plan of a playing board forming part of the game apparatus according to the invention.
Figure 2:
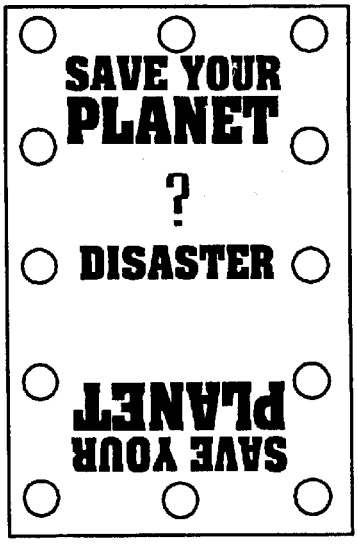
FIGS. 2 & 3 show, respectively, the back and face of a disaster card forming part of the game apparatus according to the invention.
Figure 3:
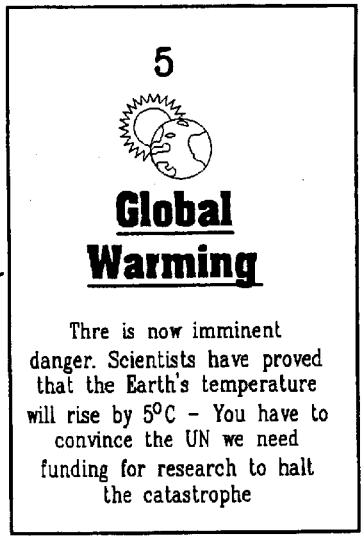
Figure 4:
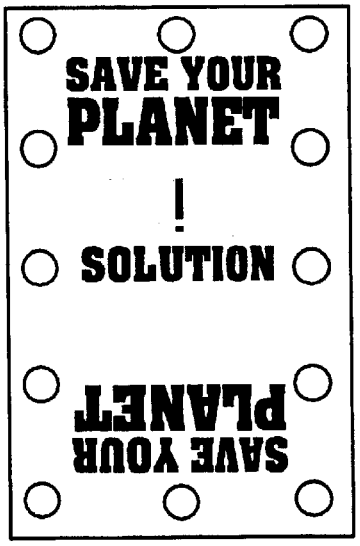
FIGS. 4 & 5 show, respectively, the back and face of a solution card forming part of the game apparatus according to the invention.
Figure 5:
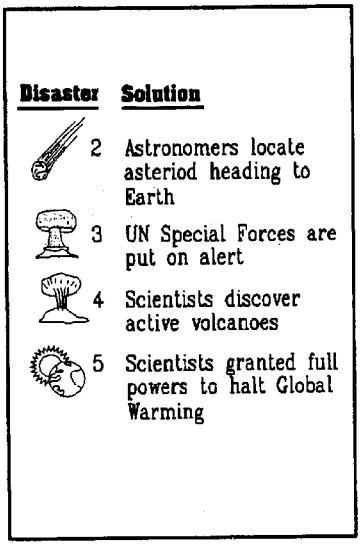
Figure 6:
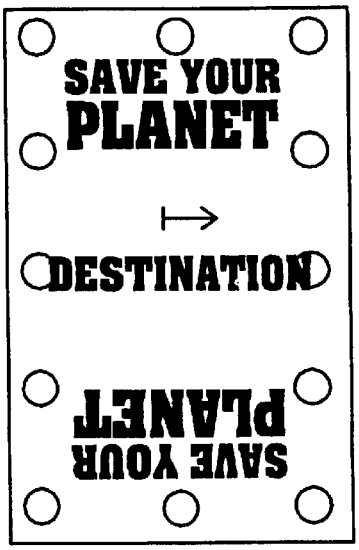
FIGS. 6 & 7 show, respectively, the back and face of a destination card forming part of the game apparatus according to the invention.
Figure 7:
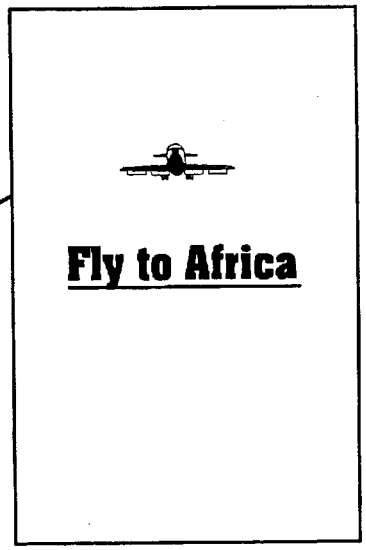
Figure 8:
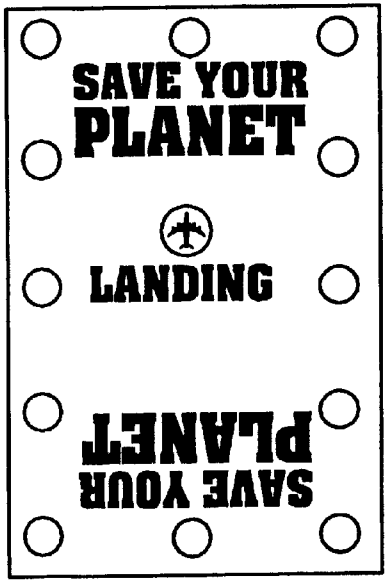
Figure 9:
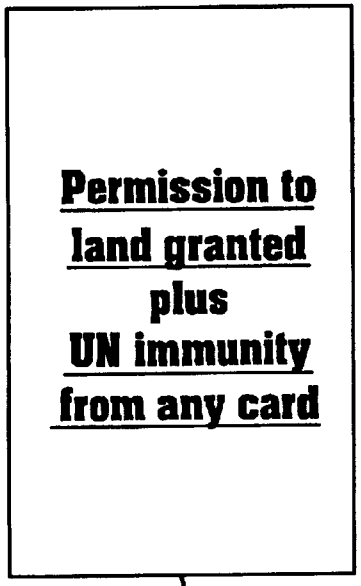
FIGS. 9 to 11 show the faces of three different examples of landing cards forming part of the game apparatus according to the invention, including a 'special card'(FIG. 11)
Figure 10:
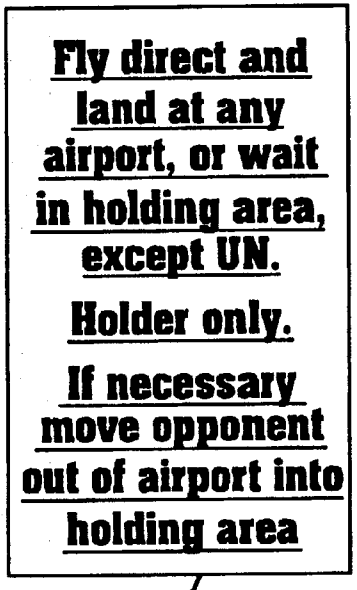
Figure 11:
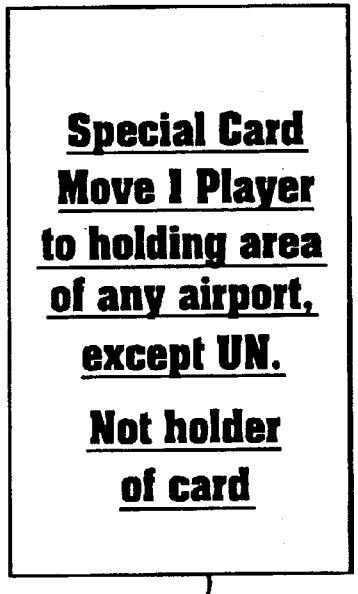
Figure 15:
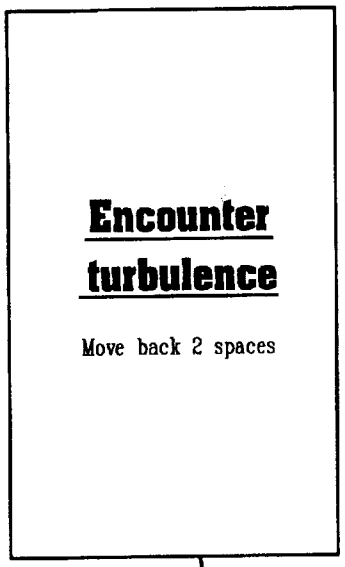
FIGS. 13 to 15 show the faces of three different examples of problem cards forming part of the game apparatus according to the invention.
Figure 14:
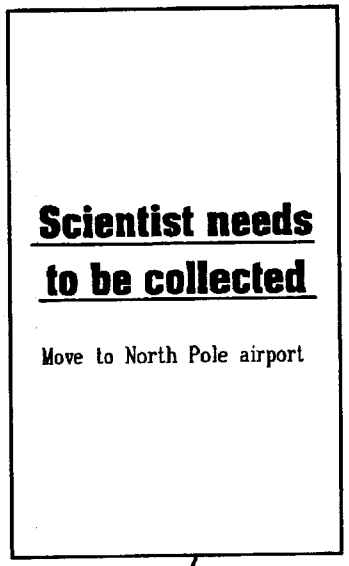
Figure 13:
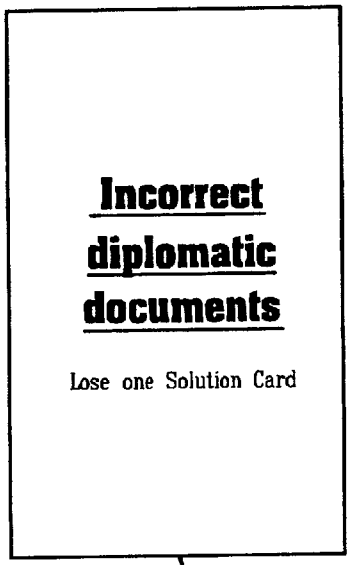
Figure 12:
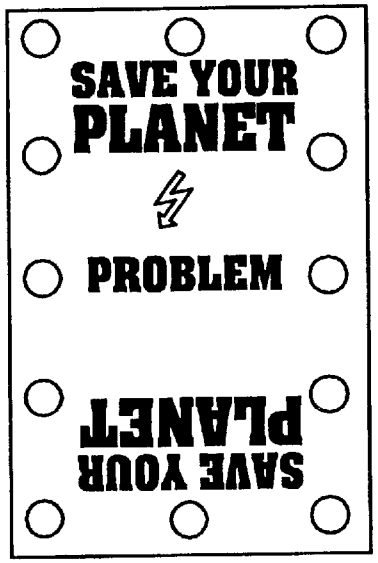

Referring to the drawings, reference numeral 20 indicates generally a playing board. The playing board 20 bears a schematic map of the world. The playing board is shown in monochrome. However, it is to be understood that different parts of the board are differently coloured in the preferred embodiment, as described below. In particular, each of the separate continents on the map of the world has a different colour. The playing board typically is of stiff card and may be adapted to be folded.

DESCRIPTION OF THE PREFERRED EMBODIMENTS

Reference numeral 22 indicates three adjacent spaces along just one of several flight paths making up a 'flight path grid'. Reference numeral 24 is used herein to refer generally to the flight path grid. The flight path grid is represented on the board 20 by interconnected circular symbols which denote various flight paths to different airports (see below).

Reference numeral 26 indicates generally a 'disaster piece grid' represented by a chain of circular symbols commencing at a disaster piece starting space 28 and terminating at a symbol 30 (e.g. an explosion) representing the "End of the World". The disaster piece grid serves as a means for establishing a limited time within which players must prevent said disaster, before the disaster occurs. The disaster piece grid 26 is a time-line or grid that is traversed by a counter (a "disaster piece"—see below) in accordance with the outcome of consecutive throws of a customised dice (not shown), such that over the course of time the counter will reach the end of the time-line or grid to signify occurrence of the disaster.

In FIG. 1 the disaster piece grid 26 may be distinguished from the flight path grid 24 by the darker shading of the former, although it is to be appreciated that on the actual playing board 20 the two grids are differently coloured.

Reference numeral 32 indicates an example of an airport. A holding area 34 can be seen surrounding the airport 32. The holding area is divided into five segments and in addition to performing an aircraft holding function (discussed below) each segment may also be considered as a further connecting space along any two flight paths linked by the airport.

Reference numeral 36 indicates the airport of the United Nations headquarters, which is connected to the flight path grid by its own flight path 38.

Figure 16:
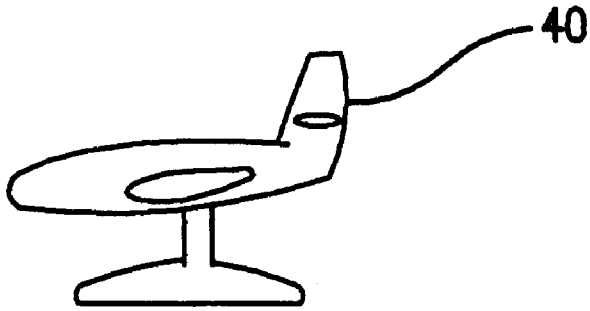
FIG. 16 shows, schematically, a side elevation of a playing piece or counter having a body portion shaped to resemble an aircraft.
Figure 17:
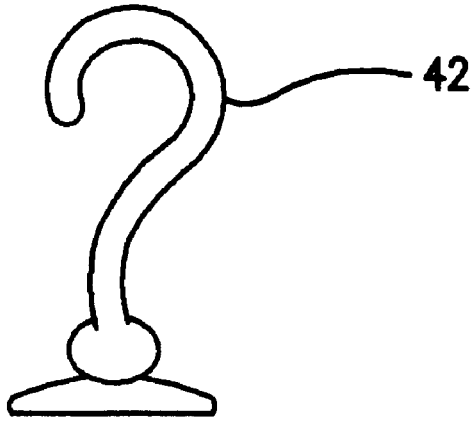
FIG. 17 shows, schematically, a side elevation of a disaster piece, having a body portion shaped to resemble a question mark.

Players using playing pieces or counters traverse the flight path grid 24. The playing pieces are typically in the form of "aircraft" 40 as illustrated schematically in FIG. 16.

The disaster piece grid 26 is traversed by a playing piece dubbed a disaster piece 42. The aircraft and the disaster piece are moved according to the outcomes of dice throws, and according to various rules and instructions contained on cards collected by players. These aspects of the game are discussed in more detail below.

In FIGS. 2 to 15 five types of cards used during play are shown. In these Figures, reference numeral 44 indicates means for establishing the nature of at least one pre-defined disaster to be prevented by players of the game. These means take the form of a disaster card. The card shown designates the disaster as "5. Global Warming"—other cards (not shown) designate other disasters. Only a single disaster card is played at the start of each game to establish the prevailing impending disaster for that game.

In this connection, particular attention should be drawn to one further aspect of the playing board 20. Reference numeral 45 indicates one example of a space along a flight path having a symbol for a disaster and a corresponding number for that disaster. The function of these spaces 45 is explained in more detail below.

Reference numeral 46 indicates means obtainable by or accessible to players for preventing said disaster from occurring, in the form of solution cards. Possible solutions to four disasters are shown on each solution card. Use of the solution cards 46 is explained below.

Reference numeral 48 indicates a destination card; reference numerals 50, 52, 54 indicate problem cards; and reference numerals 56, 58, 60 indicate landing cards. The function and use of all these cards are explained in greater detail below.

The game apparatus also includes dice (not shown). One of the dice (Dice 1) is conventionally numbered 1 to 6 and is used for moving the aircraft 40 around the playing board 20 on the flight path grid 24. The second of the dice (Dice 2) has one side bearing a black spot (requiring collection a problem card if thrown); two green sides (authorising collection of a landing card), a symbol (¤) to double the score on Dice 1; and two sides to move the disaster piece. One of these sides bears "+2" and moves the disaster piece two spaces on the grid 26 towards the End of the World symbol 30. The other side bears "−1" and moves the disaster piece backwards to provide players with more time.

To begin the game each player selects a continent for which he will play. The aircraft 40 are placed on the chosen continents' airports 32 by matching the colour of each aircraft with the colour of each continent. The disaster piece 42 is placed on its starting space 28. One player is elected as 'Card Controller'.

Players are informed of the number of solution cards 46 required before they may proceed to the United Nations headquarters 36 in order to win the game: for 2 players—8 solution cards; for 3 players—6 solution cards; for 4 players—4 solution cards; for 5 players—3 solution cards.

The disaster cards 44 are shuffled and placed face down. One player then draws the top card to show all players what impending disaster is threatening the planet (e.g. alien invasion). The remaining disaster cards will not be required for the rest of the game.

Each player is then dealt one destination card 48 and one landing card to be kept hidden from other players. The remaining landing/destination/solution/problem cards are placed faced down by the Card Controller.

The first player to throw a six or the player with the highest throw then starts the game, i.e. starts travelling around the world, with play continuing clockwise from that player. Each player looks at their destination card and works out the shortest route to the corresponding airport.

The two dice are then thrown and the instructions on the coloured dice (Dice 2) are obeyed first. If a player's landing card has a special instruction on it (e.g. "Obtain one solution card from one player", "U.N. immunity from any card", etc.) the player can play the special instruction or choose to wait until a more suitable time.

A player takes off by moving their aircraft the correct number of places—as shown by a throw of the conventional dice (Dice 1)—along a flight path towards their destination (as per the destination card issued at the start).

If another player's aircraft has landed at a player's destination airport first, blocking their landing, the blocked player is required to wait in the holding area surrounding that airport. No two aircraft can occupy the same space on the grids simultaneously; therefore, if a player lands on another player's space on the flight path grid he moves one space behind.

A player must be in possession of a landing card to be able to land at any airport except the United Nations. If a player does not have a landing card he must wait in the holding area of the airport concerned until he throws a green spot on Dice 2.

Upon landing a player must show his destination card to the other players to confirm that it corresponds with the airport at which he is landing. It must then be returned face down to the pile of destination cards. The player must then redeem one landing card, which is either given to the player playing as the continent on which he has landed, or returned to the bottom of the pile of landing cards.

Having landed the player then picks up another destination card and one solution card. If the solution card bears a solution to the impending disaster then it is kept to form part of the required final number of solution cards. If not the player may hold it so that if he is required to give up a solution card this one may be given away instead of a correct solution card.

Then on his next throw the player takes the shortest route to his next destination. If he lands on a disaster symbol 45 along a flight path and this symbol corresponds with that of the disaster that is in play then he must hand in a solution card or miss a turn.

Once a player has collected the required number of solution cards he can make his way to the United Nations airport located in the North American continent. He must travel via its flight path 38. Once he lands at the U.N. (exact throw not needed) he must show the other players the correct number of solution cards and declare that he has "Saved Planet", thereby winning the game.

However, if he loses a solution card en route to the U.N. by picking up an adverse problem card, he must go to the airport of his current destination card and continue the game until he obtains a new solution card. Once he has replaced the lost card with a further card bearing a correct solution to the disaster he may proceed back towards the U.N.

Cards may be re-shuffled and re-used as necessary.

Meanwhile, the disaster piece travels towards its destination. If it reaches it before a player reaches the U.N. with the correct number of solutions the disaster will occur and the game will be over.

The following is an extract from a rule book for the embodiment of the game herein described, and is presented as a non-limiting clarification of the purpose and function of the various components of the embodiment and their functions:

Rule Book

Contents of the Game are:

1. MAP OF THE WORLD. Board with map of the World showing continents, flight paths (making up a "flight path grid"), airports, and a grid to the countdown to the End of the World (the "disaster piece grid").
2. CARDS×82:

| | |
|---|---|
| 25 Solution cards | Yellow |
| 25 Landing cards | Green |
| 15 Destination cards | Blue |
| 12 Problem cards | Purple |
| 05 Disaster cards | Red |

3. DICE×2

| | |
|---|---|
| Dice 1: | Numbered 1–6 (to move your aircraft around the World) |
| Dice 2: | Three coloured sides: - one black side (to collect a problem card) and two green sides (to collect a landing card); a symbol (¤) to double the score on your dice; and two sides to move the disaster piece: - "+2" to move the disaster piece two spaces on the grid towards the End of the World and "−1" to move the disaster piece back to give more time. |

4. AIRCRAFT: Five diplomatic aircraft in colours corresponding to those of the continents.

5. 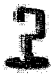 DISASTER PIECE×1

Introduction

You are a diplomat with the highest honour that your continent can bestow upon its subjects. Your mission is to "SAVE YOUR PLANET" and civilisation from extinction. You have full diplomatic powers and can use whatever resources you have at your disposal to complete the United Nations'objective and continue our way of life.

The New Millennium is Here . . . But is Our Planet Safe?

Tactics

Use your skills as a diplomat to outwit others. Plan your strategy, bluff your opponent or play a 'special card'to defend your position and change the game plan.

Can you SAVE YOUR PLANET from impending doom?

There are five disasters which can threaten the planet EARTH:

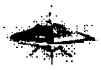 1. ALIEN INVASION

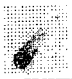 2. AN ASTEROID ON COLLISION COURSE WITH EARTH

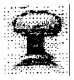 3. NUCLEAR WAR

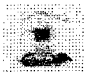 4. VOLCANOES

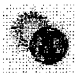 5. GLOBAL WARMING.

. . . but remember that you are racing against time!

Object of the Game

The object of the game is to be the first player to prevent one of the impending disasters from occurring and SAVE YOUR PLANET.

The Game in General

Each player has a continent chosen from one of the five different continents.

| | | |
|---|---|---|
| 1. | Europe | Blue Aircraft |
| 2. | North America | Red Aircraft |
| 3. | Asia | Purple Aircraft |

-continued

| | | |
|---|---|---|
| 4. | Africa | Green Aircraft |
| 5. | Australasia | Yellow Aircraft |

The players must then fly around the World collecting Solution Cards (SCs) as they go (the number of players determines the number of SCs required). Having collected the required number of cards a player must fly to the U.N. to declare that they have SAVED THE PLANET and thereby declare themselves the winner. However, a player can only do this provided that the disaster piece has not already completed its journey.

Players must travel in one direction only, except when on the flight path to the U.N. If a player is unfortunate enough to lose a Solution Card on this route, leaving him short of the number required, and has no Immunity Card (described in Landing Cards below), then he will be forced back to an airport to obtain another SC before returning to the U.N.

Meanwhile, the disaster piece is moving towards the End of the World and other players are desperately trying to fly to the U.N. first.

Cards and Their Use in the Game

Destination Cards

Of the fifteen Destination Cards there are three for each airport. One Destination Card is dealt to each player at the start of the game. Upon landing at the airport, your Destination Card (DC) should be revealed (along with a Landing Card). The DC card is then placed at the bottom of the relevant DC pack and a new DC issued to the player. This card will show the player their new airport to fly to, which may be on the opposite side of the World. Note: (Destination Cards are not redeemed/issued when a player is by-passing an airport).

If the DC indicates that the next destination is the airport at which you are already then a BONUS is acquired. On your next turn, instead of moving towards another airport you can throw the dice, obey the instruction on Dice 2, reveal your DC and collect a Solution Card, without using another Landing Card or indeed moving.

Landing Cards

Issued each time a green is thrown on Dice 2. The Landing Card (LC) can have two purposes: 1) to enable a player to obtain a Solution Card on arriving at a destination airport; and/or 2) to impede an opponent and increase your own chances of SAVING OUR PLANET (unless a U.N. Immunity Card is played—see Landing Card descriptions).

Landing Cards and their uses are outlined below:

"Permission to land granted":—a basic landing card—submit on arrival at destination airport to obtain Solution Card from pack.

"Permission to land granted plus obtain one solution card from one player":—submit on arrival at destination and collect one Solution Card from main pack AND collect an additional Solution Card from any player.

"Fly direct and land at any airport or wait in holding area except U.N. (holder only). If necessary move opponent out of airport into holding area":—this card can be played on your turn at any time during the game and enables the holder to land at any destination airport or holding area. Upon landing you collect a Solution Card from the pack.

"Special card—move one player to holding area of any airport except U.N.—Not holder of card":—this can be played on your turn at any time during the game and enables the holder to move any player to any airport holding area (except the U.N.) to the player's disadvantage. This card cannot be used to land.

"Permission to land granted plus U.N. immunity from any card":—a very important card which can be played at any time. Superior to all cards and used to reject any 'special card' instruction played against you.

A Landing Card must be submitted on arrival at each destination airport. If the pack of Landing Cards runs out and you have thrown a green on Dice 2 you may collect a LC off any opponent—unless a U.N. Immunity Card is played by them.

Solution Cards

Issued on arrival at each destination on the submission of a Landing Card or playing of a 'special card'—(see Landing Card descriptions).

On each Solution Card there are correct solutions for four out of five of the possible disasters. If the card shows a corresponding number and symbol to that of the disaster you are trying to prevent then you will be presented with a solution for the impending disaster. For example, if the disaster is No.1 (Alien Invasion) then on your Solution Card you look for the solution appearing alongside the number "1" and the relevant symbol:

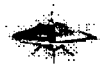

However, you may collect incorrect Solution Cards to bluff players as to the number of Solution Cards you are holding or collect them to give to another player if they request a Solution Card from you.

Problem Cards

You must pick up a problem card when you throw a black spot on Dice 2.

If you have to collect a problem card you must obey its instructions before moving. If the instruction sends you to another player's airport then you do not have to give up a Landing Card. Only a U.N. Immunity Card can be used to stop a problem card. Once the card has been used place it at the bottom of the pack.

If you are moved with a problem card to an airport which is hosting another player, then you must move that player out into the holding area so that you can land.

The following are examples of problems presented by the problem cards:

"Move to closest airport"(if a player is at an airport this can be ignored);

"Move back 2"(if a player is at an airport and throws a one or a two then he stays in the airport);

"Lose one solution"(if a player has no solution card he misses a turn);

"Move to North Pole";

"Move to South Pole"; etc.

Disaster Piece

The disaster piece travels on its own grid (the "disaster piece grid") which crosses three flight paths. If, while crossing the players' grid (i.e. the flight path grid) it lands on top of a player's aircraft, then that player must move back one space (or to the next available space backwards) and hand in one Solution Card. If you have no Solution Card miss two turns. Remember that you can only fly in one direction. If your throw means that you have to move directly into the path of the disaster piece, then that is just bad luck. However you can fly over the disaster piece. Bear in mind that the disaster piece can move forwards or backwards so it may intercept you more than once. You cannot travel on the disaster piece grid.

If at the start of the game a player throws a "−1"(move back one space) for the disaster piece but the disaster piece is still on its starting point then it stays where it is.

If the disaster piece travels to its destination before a player reaches the UN with the required number of solutions the prevailing disaster occurs and the game is lost.

Additional Notes

You can hold any number of Solution or Landing Cards, but only one Destination Card at a time.

On the players' flight path grid there are various symbols of the disasters, which threaten the aircraft. If you land on one of these and it corresponds with the disaster that you are trying to prevent then you must hand in one Solution Card (miss a turn if you do not have a Solution Card). If you land on a symbol which does not relate to the disaster in play, then you take no action and the game continues.

While en route you must obey the instructions on the coloured dice (Dice 2) first, i.e. you may collect a problem card as described earlier.

AIRSPACE—If you land at another player's airport you must give that player the Landing Card as you have entered their airspace. If a problem card moves you to this airport then no Landing Card needs to be surrendered. You cannot use a U.N. Immunity Card against this rule. However if you land at your own airport you are required to surrender one LC to the pack.

Once you have collected the correct number of Solution Cards you may proceed to the U.N. However, it is necessary to collect a Destination Card for two reasons, viz. 1) to prevent other players from knowing that you are en route to the U.N., and 2) in case you lose a Solution Card on the way and have to fly to that airport to replace a correct SC.

To win you must land at the United Nations (exact throw not needed and no Destination/Landing Card required). Once arriving and claiming the win you must reveal your correct Solution Cards to all the players.

AIRPORTS AND HOLDING AREAS—There are five holding area spaces which surround each airport, except the U.N. airport. You can fly around any airport on the way to your destination without incurring any penalty.

The inventor believes that the game as described herein has various advantages. The inventor is of the view that many people are intrigued by potential catastrophes and by ideas on how to solve them. The inventor believes that interest and enjoyment of the game accordingly arises since the object of the game is the overcoming of a planet-threatening disaster. The inventor is also of the view that interest and enjoyment is fostered by the fact that players compete "against the clock" since only a limited time is available for preventing the disaster. Thus there may be no outright winner of a particular game.

The inventor believes that the game fosters enjoyment in that it presents various opportunities for strategic and tactical play. The game may be played in different ways and each game may be different depending upon the personality-types of the players. The inventor also considers that in certain circumstances the game may give rise to amusing psychological reactions from players. For example, the inventor has noted that alliances sometimes form between players to obstruct the activities of any player who appears to be winning the game, the alliance preferring to permit the disaster to happen rather than to allow the winning player to succeed.

Finally, the inventor also believes that there are educational aspects of the game. The layout of the board to represent a map of a planet, e.g. the Earth, can communicate aspects of geography. Furthermore, the game may educate players in the various disasters which may in fact or in fiction threaten humanity on this planet, as well as putative solutions to them.

What is claimed is:

1. A method for playing a game comprising the steps of:

providing a disaster indicator;

providing a plurality of visually perceptible destination indicators;

providing a plurality of visually perceptible first paths interconnecting the destination indicators;

providing a plurality of player indicators;

providing at least one die;

in connection with a current player, using the at least one die to determine to what extent the current player's player indicator is to be moved along one of the first paths from a present position;

repeating the step of determining movement of the current player's player indicator in sequence in connection with each of the player indicators until the movement of the player indicators provides a solution for a disaster indicated by the disaster indicator;

providing a visual indicator of a second path; and in the step of determining movement of the current player's player indicator, determining whether and to what extent a counter is to be moved along the second path;

wherein the repeating step is performed until either the solution for the indicated disaster is provided or the counter is moved to an end point on the second path.

2. The method of claim 1, wherein the at least one die comprises a first die and second die, wherein the first die is usable during the step of determining movement of the current player's player indicator to determine to what extent the current player indicator is to be advanced along one of the first paths, the second die being usable to determine whether and to what extent who the counter is to be moved along the second path.

3. The method of claim 2, wherein the second die is further usable during the step of determining movement of the current player's player indicator to allocate means for enabling the solution to the event.

4. The method of claim 3, wherein the means for enabling the solution to the event comprises solution identifiers.

5. The method of claim 4, wherein the means for enabling the solution to the event further comprises landing identifiers.

6. The method of claim 5, wherein the means for enabling the solution to the event further comprises destination identifiers corresponding to the destination indicators.

7. The method of claim 6, wherein the means for enabling the solution to the event further comprises problem identifiers.

8. A method for playing a game comprising the steps of:

providing a disaster indicator;

providing a plurality of visually perceptible destination indicators;

providing a plurality of visually perceptible first paths interconnecting the destination indicators;

providing a plurality of player indicators;

providing at least one die;

in connection with a current player, using the at least one die to determine to what extent the current player's player indicator is to be moved along one of the first paths from a present position;

repeating the step of determining movement of the current player's player indicator in sequence in connection with each of the player indicators until the movement of the player indicators provides a solution for a disaster indicated by the disaster indicator;

providing solution identifiers, landing identifiers, destination identifiers, and problem identifiers;

wherein the step of determining movement of the current player's player indicator may further comprise issuing one of the problem indicators or one of the landing indicators to a player represented by the current player indicator.

9. The method of claim 8, wherein the step of determining movement of the current player's player indicator, if the current player indicator is moved to one of the destination indicators that corresponds to a landing identifier held by the current player, a replacement landing identifier and a solution identifier are issued to the current player.

10. The method of claim 9, further comprising the steps of:

providing an indicator of a second path; and in the step of determining movement of the current player's player indicator, determining whether and to what extent a counter is to be moved along the second path;

wherein the repeating step is performed until either the solution for the event is provided or the counter is moved to an end point on the second path.

11. A game comprising:

a game board comprising:

a plurality of destination indicators interconnected by sequentially arranged first indicators a sequential series of second indicators;

a plurality of disaster cards;

a plurality of solution cards, each of the solution cards having at least one solution corresponding to one of the disaster cards;

a plurality of destination cards, each of the destination cards corresponding to one of the destination indicators on the game board;

a plurality of landing cards;

a plurality of problem cards;

a plurality of player identifier pieces;

a disaster piece; and at least one die.

12. The game of claim 11, wherein the at least one die comprises a first die and a second die, wherein at least one face of the second die comprises an indication to collect one of the problem cards, and at least one die of the second die comprises an indication to collect one of the landing cards.

13. The game of claim 12, wherein at least one face of the second die comprises an indication of how the disaster piece is to be moved among the second indicators.

* * * * *